US005873695A

United States Patent [19]

Takeishi et al.

[11] Patent Number: 5,873,695

[45] Date of Patent: Feb. 23, 1999

[54] STEAM COOLED BLADE

[75] Inventors: Kenichiro Takeishi; Yoshikuni Kasai, both of Takasago, Japan

[73] Assignee: Mitsubishi Heavy Industries, Ltd., Tokyo, Japan

[21] Appl. No.: 861,539

[22] Filed: May 22, 1997

[51] Int. Cl.[6] ..... F04D 29/38

[52] U.S. Cl. ..... 415/115; 416/97 R

[58] Field of Search ..... 416/96 R, 96 A, 416/95; 415/115, 116

[56] References Cited

U.S. PATENT DOCUMENTS 3,628,885 12/1971 Sidenstick et al. .
4,940,388 7/1990 Lilleker et al. .
4,992,026 2/1991 Ohtomo et al. .
5,203,873 4/1993 Corsmeier et al. .
5,387,085 2/1995 Thomas, Jr. et al. .

*Primary Examiner*—John Kwon
*Attorney, Agent, or Firm*—Wenderoth, Lind & Ponack. L.L.P.

[57] ABSTRACT

A steam cooled blade operating in a high temperature gas with a high cooling effect on a trailing edge portion has an impingement plate, disposed in the blade lengthwise direction within a trailing edge side cooling passage formed on a trailing edge side of a moving blade. The impingement plate partitions the trailing edge side cooling passage into a convection cooling steam passage, into which steam is introduced, and an impingement cooling steam passage, formed along a trailing edge of the moving blade. The steam cooled blade further has a by-pass passage 14 for joining the steam, after it is used for cooling the moving blade, flowing from a blade tip side of the impingement cooling steam passage with the steam flowing to a leading edge direction of the moving blade from the convection cooling steam passage.

17 Claims, 3 Drawing Sheets

STEAM COOLED BLADE

BACKGROUND OF THE INVENTION:

1. Field of the Invention

The present invention relates to a steam cooled blade wherein steam is introduced in a moving blade operating in a high temperature operating gas to cool the moving blade, and especially to cool a trailing edge portion of the moving blade through impingement cooling, so that prevention of a high temperature and maintenance of structural strength can be ensured.

2. Description of the Prior Art

In a moving blade used in a gas turbine, a low temperature compressed air is introduced into a cooling passage provided within the moving blade to cool the moving blade from its interior. Consequently, the temperature of the moving blade is lowered to or below an allowable value, thus maintaining the structural strength of the moving blade.

In such air cooling of the moving blade, cooling air is first supplied into the moving blade passages through an inner cooling passage to convectively cool the moving blade from its interior. The cooling air is then discharged into a high temperature gas flowing outside an outer periphery of the moving blade through holes provided at a leading edge portion, a blade tip portion and a trailing edge portion of the moving blade to film cool the edge or tip portions.

FIG. 3 is a longitudinal cross sectional view of a central portion of a prior art air cooled blade, wherein a compressed air passing through the blade interior cools the moving blade. The interior of the moving blade 01 contains a cooling passage 04 running in a lengthwise direction of the blade 01 between a blade root portion 02 and a blade tip portion 03. A plurality of rows of the cooling passage 04 is provided in a blade chord direction, in other words from front to rear, of the moving blade 01 and is sectioned into a plurality of systems in the blade chord direction.

A cooling air 05 is introduced into the cooling passage 04 from an air passage provided within a rotor (not shown). The cooling air then passes to an outer periphery of the blade root portion 02, which is fitted to be rotated together with the moving blade 01, via an inlet passage 010 provided within the blade root portion 02. While passing through the moving blade 01 in the lengthwise direction between the blade root portion 02 and the blade tip portion 03, the cooling an convectively cools the moving blade 01 from its interior.

A portion of the cooling air 05 entering the inlet passage 010, after convectively cooling the moving blade 01, is discharged with a high velocity into a high temperature operating gas 09, flowing outside an outer periphery of the moving blade 01, through openings 06 provided at a leading edge portion 011 of the moving blade 01 so as to make a film cooling of a blade profile portion. Also, a portion of the cooling air 05, after convectively cooling a blade trailing edge portion 012, is discharged into the high temperature operating gas 09 through holes 07 provided at the blade trailing edge portion 012 and openings 08 provided at the blade tip portion 03.

In addition, turbulator (a turbulence promoter) 014 is disposed perpendicular to a flow of the cooling air 05, within the cooling passage 04, to make the flow of the cooling air 05 turbulent so as to enhance a cooling efficiency.

As mentioned above, in the prior art air cooled blade, the blade thickness at the blade trailing edge portion 012 of the moving blade 01 is thinner than the rest of the blade for operating efficiency of the moving blade 01. Hence, the structural strength is low and a high temperature strength could damage the moving blade. Thus, an air passage of the cooling air is cooled by the use of a convection cooling structure so that a high temperature is prevented, the structural strength is maintained and a lowering of efficiency is prevented.

Further, a recent trend toward a high temperature gas turbine indicates the use of a higher temperature operating gas for further improvement of the gas turbine thermal efficiency. For this purpose, there have been attempts of using a material which maintains its strength at a higher temperatures. There have been also been attempts to use a steam cooled blade in which steam, having a high thermal capacity and therefore being able to enhance cooling efficiency, is used to cool the moving blade in place of compressed air.

However, if the steam in a steam cooled blade, after it is used for cooling, is discharged into the high temperature gas 09, thus cooling the gas as well, the thermal efficiency of the gas turbine is greatly reduced. Thus it is necessary for all of the cooling steam to be recovered in order to enhance the total thermal efficiency of a turbine plant. Thus the cooling structure used in air cooled blade cannot be used in the high temperature gas turbines. Cooling the trailing edge portion 012 of the moving blade 01 is especially difficult, as the blade thickness is relatively thin and forming the cooling passage 04 necessary for a steam flow for cooling is problematic.

SUMMARY OF THE INVENTION

In order to solve the problems of the cooling structure of the prior art steam cooled blade, it is an object of the present invention to provide an impingement plate disposed in a cooling passage of a steam cooled blade operating in a high temperature operating gas for improved thermal efficiency. The present invention is especially useful for strengthening and cooling the trailing edge portion of the moving blade, thereby causing an impingement cooling to occur so as to cool the trailing edge portion with a heat transfer rate which is 5 to 10 times higher than convection cooling. Furthermore, all the steam used for the cooling is recovered and the gas turbine efficiency is increased.

To this end, the present invention provides a steam cooled blade, operating in a high temperature operating gas, that is cooled by steam passing through a cooling passage formed in a lengthwise direction within the moving blade. The moving blade is made up of an impingement plate disposed in the lengthwise direction within a trailing edge side cooling passage formed on a trailing edge side of said moving blade. The impingement plate partitions the trailing edge side cooling passage into a convection cooling steam passage in which the steam is introduced and an impingement cooling steam passage formed along a trailing edge of the moving blade. The moving blade further comprises a by-pass passage for joining the impingement steam, flowing from a blade tip side of said impingement cooling steam passage, to the steam from said convection cooling steam passage flowing to a leading edge direction of the moving blade.

The above-mentioned steam cooled blade, according to the present invention, employs a structure that is able to cool through impingement cooling at the trailing edge portion of the moving blade which is minimally cooled through convection cooling. Impingement cooling enhances the heat transfer rate, as compared with convection cooling, by forcing the steam in the convection cooling steam passage into the impingement cooling steam passage with a high velocity. The present invention also employs a by-pass passage which facilitates the pressure difference necessary for the impingement cooling as well as the recovery of steam, after it is used for the impingement cooling. Hence the cooling efficiency at the trailing edge portion of the moving blade, where the heat transfer rate cannot be increased and where cooling is difficult due to the thinness of the blade and to the low steam flowrate, can be increased.

Thus, the blade thickness can be decreased and an extreme temperature at the trailing edge portion, where the structural strength is small and therefore the thermal capacity is also small, can be prevented, so that the blade is not weakened. Consequently, the temperature of the operating gas flowing outside the periphery of the moving blade can be elevated so that the thermal efficiency of the gas turbine can also be enhanced.

Further, the impingement pressure difference for effecting the impingement cooling is facilitated by providing a by-pass passage. The steam is passed through the by-pass passage after it is used for the impingement cooling. The impingement steam is then recovered, together with the steam used for the convection cooling in the moving blade, without being discharged into the operating gas.

Thus, the thermal efficiency of the turbine plant can be increased by preventing the discharge of the steam into the operating gas and also preventing the thermal energy from becoming absorbed by discharged steam.

Also, the present invention provides a steam cooled blade as mentioned above, wherein the by-pass passage is formed by a blade tip portion member of the trailing edge side of the moving blade and a by-pass plate extending toward a leading edge side from a blade tip portion, on an inner side of the blade tip portion member, of the impingement cooling steam passage, so as to be disposed in a blade chord direction in the blade tip portion of the moving blade.

According to the steam cooled blade of the above invention, a by-pass passage is provided in the blade tip portion, thereby generating the impingement pressure difference necessary for effecting impingement cooling. By use of the impingement cooling steam flowing out of the blade tip portion of the impingement cooling steam passage and through the by-pass passage, the blade tip portion of the trailing edge side of the moving blade can be cooled continuously and the strength of the blade tip portion of the trailing edge side can be increased.

DESCRIPTION OF THE PREFERRED EMBODIMENTS

Figure 1:
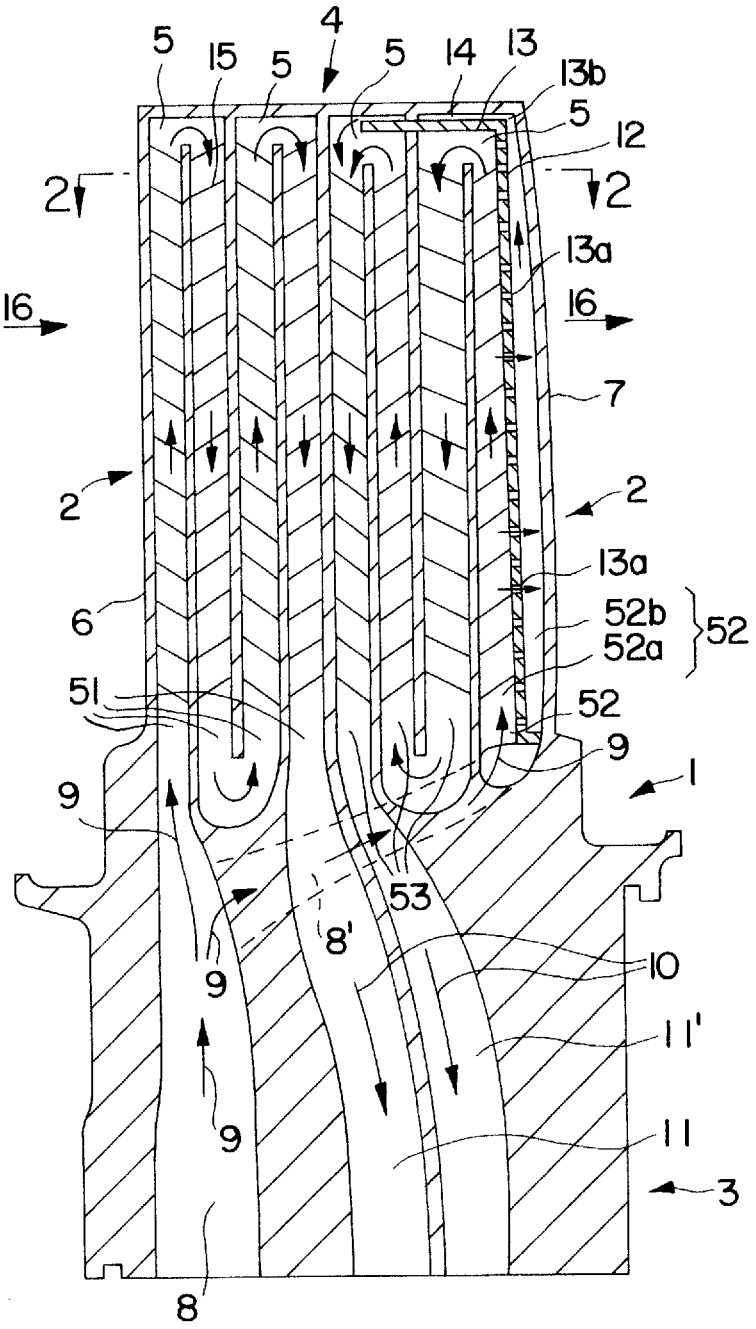
FIG. 1 is a longitudinal cross sectional view showing one preferred embodiment of a steam cooled blade according to the present invention.
Figure 2:
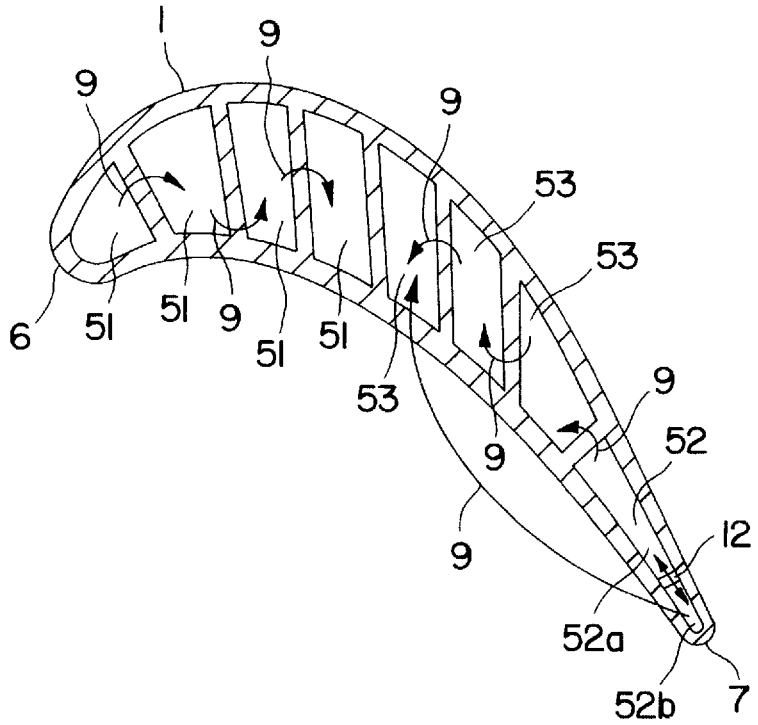
FIG. 2 is a cross sectional view taken along line 2—3 in FIG. 1.
Figure 3:
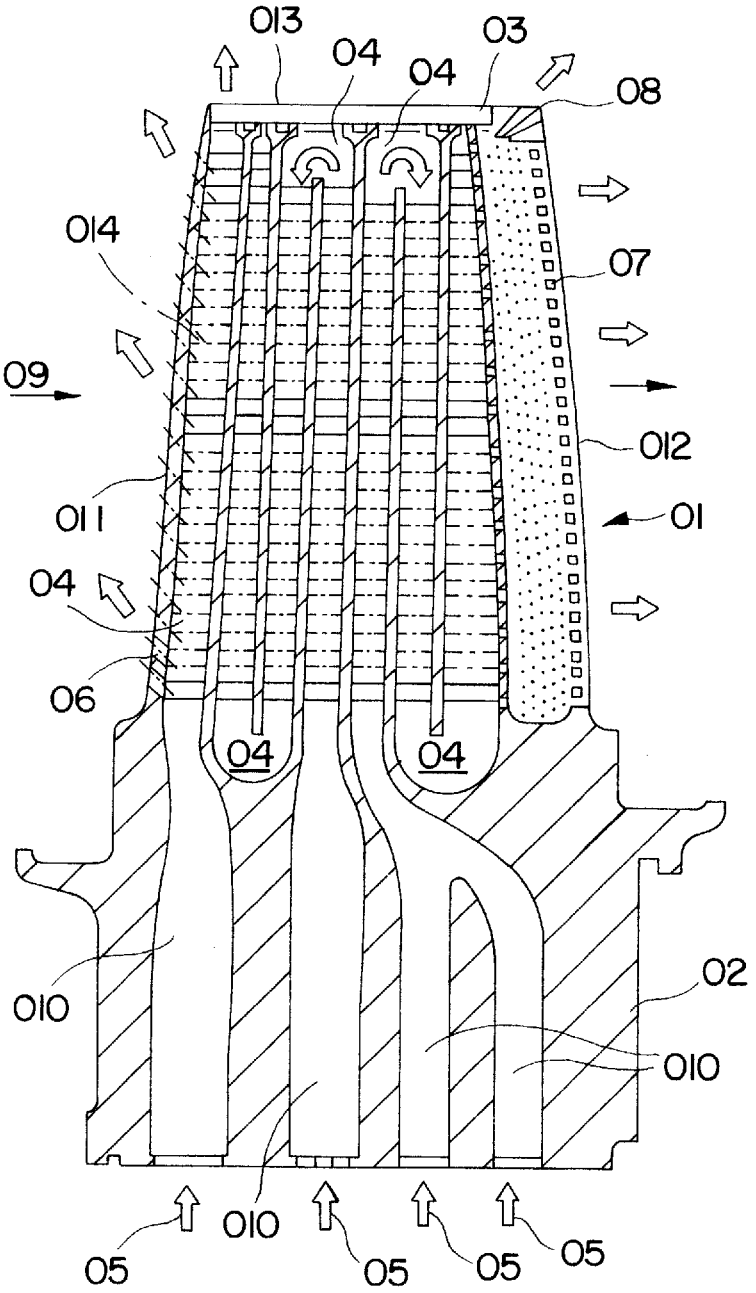
FIG. 3 PRIOR ART
FIG. 3 is a longitudinal cross sectional view of a prior art air cooled blade.

A preferred embodiment of a steam cooled blade according to the present invention is described with reference to FIGS. 1 and 2. As shown in the figures, in a blade profile portion 2 of a moving blade 1, there is disposed a cooling passage 5, extending from a blade root portion 3 to a blade tip portion 4. The cooling passage 5 is formed in a plurality of rows in a blade chord direction. The cooling passage 5 is provided in a group of systems, on a leading edge side and a trailing edge side, respectively, of the moving blade 1. Within cooling passage 5, there are disposed a multitude of turbulators (a turbulence promoter) 15 in a direction crossing the flow direction of a cooling steam 9, so that the flow of the cooling steam 9 becomes turbulent, thus enhancing the heat transfer rate.

The cooling steam 9 enters an inlet passage 8 from a steam passage provided in a rotor (not shown) and flows into a front side cooling passage 51 of a frontmost row disposed along a leading edge 6 of the blade. The steam flows from a blade root portion 3 to a blade tip portion 4 before turning by 180 degrees at the blade tip portion 4 to flow to the blade root portion 3. The steams turns again by 180 degrees at the blade root portion 3 to flow to the blade tip portion 4, before turning still again by 180 degrees to flow to the blade root portion 3 side, all the while convectively cooling of the interior of the leading edge side of the moving blade 1. Finally, the steam flows out of a front side outlet passage 11 into a steam passage in the rotor as a recovery steam 10.

Also, a cooling passage 5, which consists of a trailing edge side cooling passage 52, is disposed along a trailing edge 7 side. Cooling steam 9 diverged from the inlet passage 8 flows through an inlet by-pass passage 8' and into the trailing edge side cooling passage. A rear side cooling passage 53 is disposed in three rows in the blade chord direction at a front side of the trailing edge side cooling passage 52.

The trailing edge side cooling passage 52 is partitioned by an impingement plate 12, disposed in a blade lengthwise direction, into two parts, a convection cooling steam passage 52*a* of a front side and an impingement cooling steam passage 52*b* of a rear side. The cooling steam 9, diverged from the inlet passage 8 and entering the trailing edge side cooling passage 52, first flows to the blade tip portion 4 side along the impingement plate 12, before turning by 180 degrees at an inner peripheral side of a by-pass plate 13, disposed at the blade tip portion 4. The cooling steam then flows to the blade root portion 3 side, turns again by 180 degrees at the blade root portion 3 to flow to the blade tip portion 4, turns still again to flow to the blade root portion 3 side, all the while convectively cooling the interior of the trailing edge side of the moving blade 1. Finally, the steam flows out of a rear side outlet passage 11', provided on a rear side of the front side outlet passage 11, into a steam passage in the rotor as a recovery steam 10.

Further, a portion of the cooling steam 9, entering the trailing edge side cooling passage 52, passes through impingement holes 13*a* provided in the impingement plate 12, in the blade lengthwise direction, into the impingement cooling steam passage 52*b* to make an impingement cooling of the trailing edge 7 portion.

The cooling steam 9, after cooling through the impingement cooling, flows through the impingement cooling steam passage 52*b* to the blade tip portion 4 side, through an impingement passage exit 13*b* and then toward the leading edge side through a by-pass passage 14. The by-pass passage is formed by a blade tip portion 4 member and the by-pass plate 13 disposed in the blade chord direction. The by-pass plate 13, in turn, forms an outer peripheral end wall of the convection cooling steam passage 52*a* and of the rear side cooling passage 53.

After passing through the by-pass passage 14, the cooling steam 9 joins the steam flowing in the rear side cooling passage 53. Steam from the two passages merges at an outer periphery of the rear side cooling passage 53 of a frontmost row and then flows out of the rear side outlet passage 11' into the steam passage in the rotor as recovery steam 10.

According to the steam cooled blade of the preferred embodiment, the portion where the blade thickness is comparatively large and an adequate flow rate of cooling steam 9 can be maintained is cooled convectively by use of the cooling steam 9 flowing in the convection cooling steam passage 52*a* and in the rear side cooling passage 53. On the other hand, the trailing edge 7 portion where the blade thickness is small and a passage for maintaining an adequate flow rate of cooling steam 9 cannot be formed is cooled by an impingement cooling by use of the cooling steam 9 forced through the impingement plate 12. Thus, the blade may be cooled with a high rate of heat transfer, thereby increasing the cooling efficiency of the trailing edge 7 portion and maintaining the strength of the trailing edge 7 portion of the blade.

Consequently, the temperature of the operating gas, flowing outside a periphery of the moving blade 1 can be further increased, so that the thermal efficiency of a gas turbine can also be increased.

Also, according to the steam cooled blade of the preferred embodiment, the cooling steam 9, after cooling through impingement cooling, flows through the impingement cooling steam passage 52*b* and through the by-pass passage 14 before joining the convection cooling steam 9 and flowing out the rear side outlet passage 11'. Thus, an impingement pressure difference can be sufficiently established.

To elaborate, a pressure loss at the impingement cooling steam passage 52*b* and the bypass passage 14 through which the cooling steam 9 passes, after it is used for the impingement cooling, is less than that of the convection cooling steam passage 52*a* and the rear side cooling passage 53 thereby establishing the impingement pressure difference.

Further, in contrast to air cooling in the prior art, the cooling medium used for the impingement cooling is not discharged into the high temperature operating gas, hence no lowering of a gas turbine thermal efficiency occurs due to temperature lowering of the high temperature operating gas. In addition, the recovery steam 10, having an elevated temperature, can be used for taking power from a steam turbine employed in a combined cycle plant etc. or can also be used for ancillary machinery and equipment of a gas turbine. Thus, the total thermal efficiency of a turbine plant can be increased.

As described above, according to the steam cooling blade of the present invention, the following effects are obtained:

(1) Greater cooling of the trailing edge portion of the moving blade is accomplished, the temperature of the operating gas can be increased and the moving blade metal temperature becomes adjustable varying a flow rate of impingement steam.

(2) There is no necessity of discharging the cooling steam from the trailing edge side into the high temperature operating gas, and all the cooling steam with a high energy can be recovered. Thus, the thermal efficiency of the gas turbine is increased.

While the preferred form of the present invention has been described, variation thereto will occur to those skilled in the art within the scope of the present inventive concepts which are delineated by the following claims.

What is claimed is:

1. A fluid cooled blade comprising:

a main body having a leading edge side, a trailing edge side and a blade tip side;

a cooling passage formed within said main body;

a trailing edge side cooling passage formed in said trailing edge side of said main body;

an impingement plate located within said trailing edge side cooling passage, which partitions said trailing edge side cooling passage into a convection cooling fluid passage and an impingement cooling fluid passage; and a by-pass passage located within said main body, which is in fluid communication with said impingement cooling fluid passage and said trailing edge side cooling passage.

2. The fluid cooled blade as claimed in claim 1, further comprising:

a blade root portion, located within said main body, having an inlet passage, an inlet by-pass passage in fluid communication with said inlet passage, a front side outlet passage, and a rear side outlet passage;

wherein said cooling passage is in fluid communication with said inlet passage and said front side outlet passage, and said trailing edge side cooling passage is in fluid communication with said inlet by-pass passage and said rear side outlet passage.

3. The fluid cooled blade as claimed in claim 2, wherein said convection cooling fluid passage is in fluid communication with said inlet by-pass passage.

4. The fluid cooled blade as claimed in claim 1, wherein said impingement plate has one or more impingement holes.

5. The fluid cooled blade as claimed in claim 4, wherein said convection cooling fluid passage is in fluid communication with said impingement cooling fluid passage via said impingement holes.

6. The fluid cooled blade as claimed in claim 1, wherein said main body has a blade lengthwise direction and said cooling passage is formed in said blade lengthwise direction.

7. The fluid cooled blade as claimed in claim 1, wherein said main body has a blade lengthwise direction and said impingement plate is disposed in said blade lengthwise direction.

8. The fluid cooled blade as claimed in claim 1, wherein said impingement cooling fluid passage is formed in said trailing edge side of said main body.

9. The fluid cooled blade as claimed in claim 1, wherein said impingement cooling fluid passage has an impingement passage exit located at said blade tip side of said main body, and said by-pass passage is in fluid communication with said impingement passage exit.

10. The fluid cooled blade as claimed in claim 1, further comprising:

a blade tip portion located on said main body, said blade tip portion having a blade tip portion member disposed on a trailing edge side thereof;

a by-pass plate located inside of said blade tip portion member and extending toward said leading edge side of said main body in a blade chord direction;

wherein said by-pass passage is formed by said blade tip portion member and said by-pass plate.

11. A steam cooled moving blade for operation in a high temperature operating gas, said steam cooled blade comprising:

a main body having a leading edge side, a trailing edge side, a blade tip side, and a blade lengthwise direction;

a cooling passage formed within said main body in said blade lengthwise direction;

a trailing edge side cooling passage formed in said trailing edge side of said main body;

an impingement plate, located within said trailing edge side cooling passage in said blade lengthwise direction, which partitions said trailing edge side cooling passage into a convection cooling steam passage and an impingement cooling steam passage, said impingement cooling steam passage being formed along said trailing edge side of said main body; and a by-pass passage located within said main body, which is in fluid communication with said impingement cooling steam passage and said trailing edge side cooling passage.

12. The steam cooled moving blade as claimed in claim 11, further comprising:

a blade root portion, located within said main body, having an inlet passage, an inlet by-pass passage in fluid communication with said inlet passage, a front side outlet passage, and a rear side outlet passage outlet;

wherein said cooling passage is in fluid communication with said inlet passage and said front side outlet passage, and said trailing edge side cooling passage is in fluid communication with said inlet by-pass passage and said rear side outlet passage.

13. The steam cooled moving blade as claimed in claim 12, wherein said convection cooling steam passage is in fluid communication with said inlet by-pass passage.

14. The steam cooled moving blade as claimed in claim 11, wherein said impingement plate has one or more impingement holes.

15. The steam cooled moving blade as claimed in claim 14, wherein said convection cooling steam passage is in fluid communication with said impingement cooling fluid passage via said impingement holes.

16. The steam cooled moving blade as claimed in claim 11, wherein said impingement cooling steam passage has an impingement passage exit located at said blade tip side of said main body, and said by-pass passage is in fluid communication with said impingement passage exit.

17. The steam cooled moving blade as claimed in claim 11, further comprising:

a blade tip portion located on said steam cooled blade, said blade tip portion having a blade tip portion member disposed on a trailing edge side thereof;

a by-pass plate located inside of said blade tip portion member and extending toward a leading edge side of said steam cooled blade in a blade chord direction;

wherein said by-pass passage is formed by said blade tip portion member and said by-pass plate.

* * * * *